US008022783B2

(12) United States Patent
Pietig

(10) Patent No.: US 8,022,783 B2
(45) Date of Patent: Sep. 20, 2011

(54) NON-RECIPROCAL CIRCUIT ELEMENT

(75) Inventor: Rainer Pietig, Aachen (DE)

(73) Assignee: NXP B.V., Eindhoven (NL)

( * ) Notice: Subject to any disclaimer, the term of this patent is extended or adjusted under 35 U.S.C. 154(b) by 1527 days.

(21) Appl. No.: 10/538,580

(22) PCT Filed: Dec. 9, 2003

(86) PCT No.: PCT/IB03/05765

§ 371 (c)(1),
(2), (4) Date: Jun. 15, 2005

(87) PCT Pub. No.: WO2004/055936

PCT Pub. Date: Jul. 1, 2004

(65) Prior Publication Data

US 2006/0152296 A1 Jul. 13, 2006

(30) Foreign Application Priority Data

Dec. 17, 2002 (EP) ..... 02102777

(51) Int. Cl.
*H01P 1/32* (2006.01)

(52) U.S. Cl. ..... 333/1.1; 333/24.2

(58) Field of Classification Search ..... 333/1.1, 333/24.2

See application file for complete search history.

(56) References Cited

U.S. PATENT DOCUMENTS 6,710,671 B1 * 3/2004 Tanaka ..... 333/1.1
2001/0028280 A1 * 10/2001 Maruhashi et al. ..... 333/1.1

FOREIGN PATENT DOCUMENTS

EP 0618636 A1 10/1994
EP 0618636 A2 10/1994
EP 0 618 636 B1 6/2000
JP 09294006 A * 11/1997

* cited by examiner

*Primary Examiner* — Stephen E Jones

(57) ABSTRACT

The invention relates to a non-reciprocal circuit element (1) having a plurality of strip conductor elements (2) insulated electrically from one another, which conductor elements are embedded in a multilayer core (3) of ferrimagnetic material and are arranged in superposed conductor planes in such a way that the conductor elements (2) cross over one another in at least one crossover area (4, 5). To provide such a circuit element, which is particularly cost-effective to produce and which is suitable in particular for use in mobile phones, the invention proposes that the core (3) comprises, at least in the crossover area of the conductor elements (2), hard magnetic material, which is permanently magnetized in a spatial direction perpendicular to the conductor planes.

5 Claims, 2 Drawing Sheets

NON-RECIPROCAL CIRCUIT ELEMENT

The invention relates to a non-reciprocal circuit element having a plurality of strip conductor elements insulated electrically from one another, which conductor elements are embedded in a multilayer core of ferrimagnetic material and are arranged in superposed conductor planes in such a way that the conductor elements cross over one another in at least one crossover area.

Such non-reciprocal circuit elements comprise circulators or isolators, for example. These are used inter alia in mobile phones, where they are connected between the output of the booster and the antenna. The non-reciprocal circuit element is intended to protect the output of the booster from radio frequency signals reflected at the antenna. In the case of a mismatched mobile phone antenna, some of the radio frequency signals output by the booster are reflected, such that the output of the booster is loaded with radio-frequency signals of considerable power. Antenna mismatches arise virtually constantly with conventional mobile phones, since the impedance of the narrow band antennae used is strongly dependent on environmental influences. The radio-frequency power reflected onto the booster disadvantageously produces distortions in the signals emitted by the mobile phone. Such signal distortions are undesirable, especially in so-called third generation mobile phones, since a linear and thus distortion-free transmission characteristic is absolutely essential for error-free functioning of the modulation and demodulation technology used in these devices.

A non-reciprocal circuit element of the above-mentioned type is known, for example, from EP 0 618 636 B1. This publication relates to a circulator, in which the strip conductor elements insulated electrically from one another are embedded in a core of soft magnetic ferrite. The core consists of a plurality of superposed layers of YIG (yttrium iron garnet), which are sintered together during production of the previously known circulator. In order that the gyromagnetic effect required for the circulator to function occurs, the soft magnetic material of the core has to be magnetized in the case of the previously known circulator by two permanent magnets arranged above and below the core. The entire arrangement is surrounded by a metallic housing, which serves as a magnet yoke.

The primary disadvantage of the previously known circulator is that the production thereof is associated with high production costs, in particular because the positioning of the permanent magnets on the core of the previously known circulator has to be extremely precise, with the smallest possible mechanical tolerances, as does assembly of the housing serving as a magnet yoke. The magnetization of the core and thus its gyromagnetic behavior are greatly influenced by the positioning of the permanent magnets. Even slight tolerances in assembly of the previously known circulator may therefore have a catastrophic effect on the electrical characteristics thereof. This may result in a need for subsequent tuning and adjustment of the circuit element during production, which further increases production costs. A further disadvantage of the previously known circuit element is its relatively large size, which is determined primarily by the large amount of space required by the permanent magnets.

In so-called third generation mobile phones, the use of non-reciprocal circuit elements is absolutely essential for the reasons outlined above. Because of the large numbers of such circuit elements required in the mobile phone sector, it is desirable to be able to manufacture them at the lowest possible cost. Since modern mobile phones have to be compatible with a plurality of transmission standards (e.g. GSM, UMTS etc.) and since it is necessary for this purpose to incorporate a large number of separate circuit elements for the respective frequency bands in one device, the dimensions of the individual circuit elements have to be smallest possible.

Accordingly, it is an object of the present invention to provide a further-developed non-reciprocal circuit element which has particularly small dimensions and may be produced at low cost.

Taking a non-reciprocal circuit element of the above-mentioned type as basis, this object is achieved in that the core comprises, at least in the area where the conductor elements cross over one another, hard magnetic material, which is permanently magnetized in a spatial direction perpendicular to the conductor planes.

In contrast to the soft magnetic materials used in conventional non-reciprocal circuit elements, the hard magnetic material used according to the invention for the core has a strong remanent magnetization, which means that the core may be magnetized on a one-off basis during production, such that the finished circuit element manages completely without permanent magnets. Manufacturing tolerances are of virtually no significance, since the magnetic field acting on the circuit element for magnetization may be adjusted so as to correspond to the desired specification of the circuit element.

Because, according to the invention, the fitting of permanent magnets to the non-reciprocal circuit element is unnecessary and because mechanical tolerances are thereby of virtually no significance in assembly of the circuit element, a considerable reduction in production costs relative to the prior art is achieved. Furthermore, the spatial dimensions of the circuit element according to the invention are markedly reduced relative to the circuit elements known from the prior art because of the lack of permanent magnets. It is clear that the circuit element according to the invention, whose electromagnetically active core comprises hard magnetic material, is well suited to third generation mobile phone applications. Barium hexaferrite is an example of a suitable material for the core.

In an appropriate further development of the invention, the non-reciprocal circuit element comprises an upper and a lower outer layer of soft magnetic material. After magnetization of the core, the magnetization in the outer layers is so aligned that a closed-loop magnetic field pattern is automatically established. The soft magnetic outer layers function to a certain extent as a magnet yoke.

It is particularly appropriate for the upper and/or lower outer layers to be separated from the core each by an electrically conductive separator layer. This electrically conductive separator layer should advantageously be grounded. In this way it is ensured that the electromagnetic radio-frequency signals propagate solely in the hard magnetic core of the circuit element and do not penetrate for instance into the soft magnetic layer, thereby reducing signal losses.

The strip conductor elements of the non-reciprocal circuit element according to the invention should advantageously cross over one another in pairs at an angle of 120°. Three conductor elements arranged accordingly produce a circulator with three terminals.

In a particularly advantageous further development of the circuit element according to the invention, two spatially separate crossover areas of the conductor elements are provided, the hard magnetic material of the core being oppositely magnetized in the respective crossover areas. In this way, a circulator with four terminals may be particularly simply produced, which comprises two circulators with three terminals, one of the conductor elements simultaneously forming the output of the one and the input of the other circulator. If the circuit element is constructed according to the invention in three layers, the hard magnetic core being surrounded by an upper and a lower outer layer of soft magnetic material, the opposite magnetization of the core advantageously produces, as it were automatically, a closed-loop field pattern within the component. Metallic housing parts serving for instance as a magnet yoke are unnecessary in the circuit element produced accordingly, which in turn leads to low production costs and to a reduction in the dimensions of the circuit element.

Non-reciprocal circuit elements according to the invention may advantageously be produced from ceramic substrates in conventional multilayer technology. HTCC and LTCC (high/low temperature cofired ceramic) technologies are likewise possible. Such production processes usually begin with cutting "green" foils of unfired ceramic substrate to size. Plated-through openings are then produced in these foils, which openings are filled with electrically conductive conductor paste. The strip conductor elements required for the non-reciprocal circuit element are then printed onto the foils, for example by screen printing or stencil printing. Once the foils have been dried, they are stacked into a foil stack, which is then compacted and subsequently sintered in a furnace. When producing a non-reciprocal circuit element according to the invention, the foil stack comprises a plurality of inner foils of hard magnetic material and at least one upper and at least one lower outer foil of soft magnetic material, the strip conductor elements being printed on the inner foils in such a way that conductor elements superposed in the foil stack cross over one another in at least one crossover area. Electrically conductive separator layers between the outer foils and the inner foils may be produced by metallizing the entire surface of the corresponding outer and inner foils respectively. A final method step in the production of the non-reciprocal circuit element according to the invention comprises magnetization of the sintered foil stack in a direction perpendicular to the foil planes. In this way, the hard magnetic material of the core is permanently magnetized in accordance with the specification of the circuit element.

The invention will be further described with reference to examples of embodiments shown in the drawings to which, however, the invention is not restricted. In the Figures.

Figure 2:
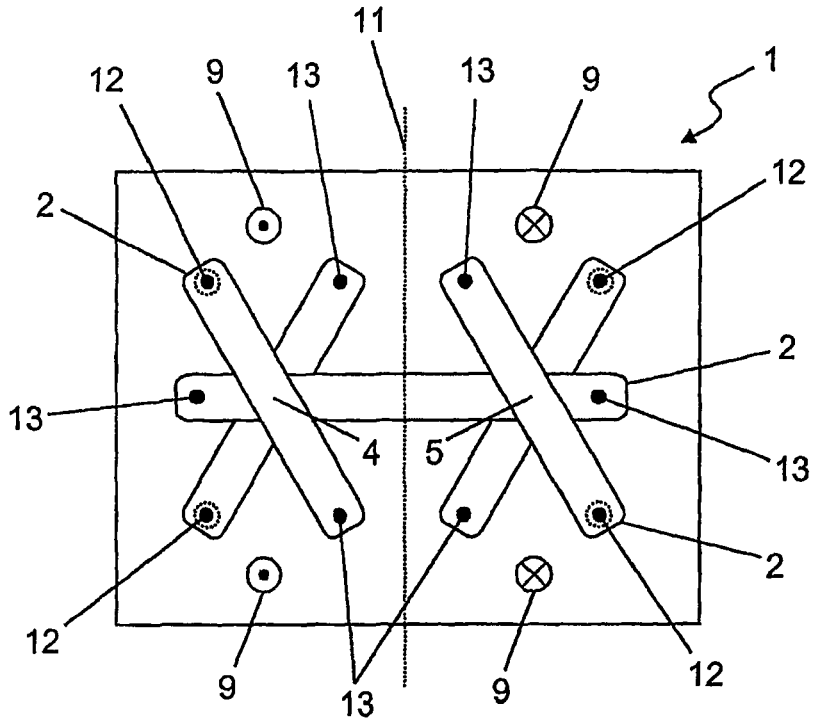
FIG. 2 is a plan view of the circulator according to FIG. 1.
Figure 3:
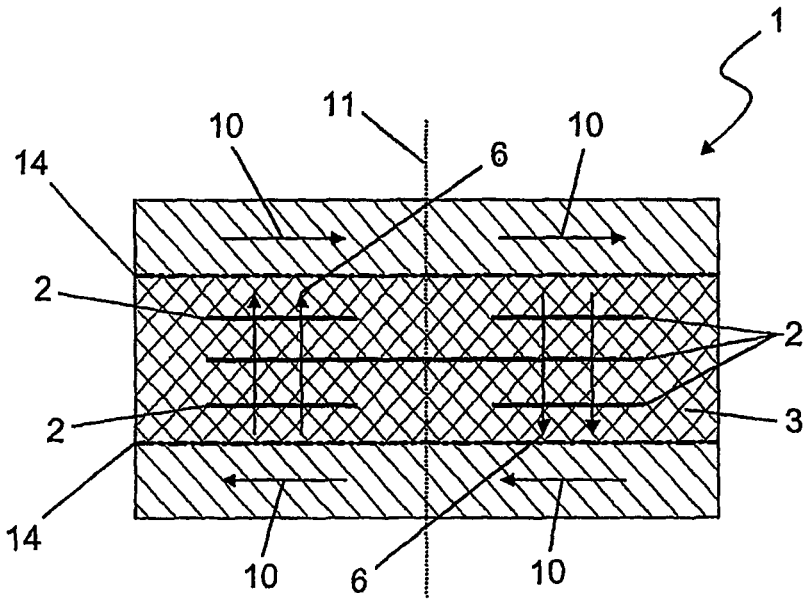
FIG. 3 is a cross-sectional representation of the circulator.

The 4-port circulator 1 illustrated in the Figures comprises a plurality of strip conductor elements 2 electrically insulated from one another. As is clear from FIG. 3, these are embedded in a core 3, which comprises, according to the invention, hard magnetic material, for example barium hexaferrite. The conductor elements 2 are arranged in mutually superposed conductor planes and cross over one another in two crossover areas 4 and 5. The arrows 6 in FIG. 3 indicate that the hard magnetic material of the core 3 is permanently magnetized in a spatial direction perpendicular to the conductor planes. The circulator illustrated comprises an upper outer layer 7 and a lower outer layer 8 of soft magnetic material. The material may be YIG (yttrium iron garnet), for example. As shown by the symbols 9 in FIG. 2 and the arrows 6 in FIG. 3, the hard magnetic material of the core 3 is oppositely magnetized in the respective crossover areas 4 and 5. The arrows 10 illustrated in FIG. 3 show that the magnetization in the soft magnetic material of the upper and lower outer layers is so aligned that a closed-loop field pattern is produced. The magnetic field lines inside the circulator 1 then exhibit a closed-loop pattern. The oppositely magnetized areas of the core 3 are separated from one another in FIGS. 2 and 3 by a broken line 11. The 4-port circulator illustrated in the Figures comprises in principle two 3-port circulators, which are connected together by means of the conductor element 2 extending horizontally in FIG. 2. A crossover area 4 or 5 is assigned to each of the two 3-port circulators, respectively. In FIG. 2, the four signal terminals of the circulator carry reference numeral 12. Terminals 13 serve to ground the circuit element. FIG. 3 shows two electrically conductive layers 14, by means of which the upper and lower outer layers 7 and 8 respectively are separated from the core 3.

Figure 1:
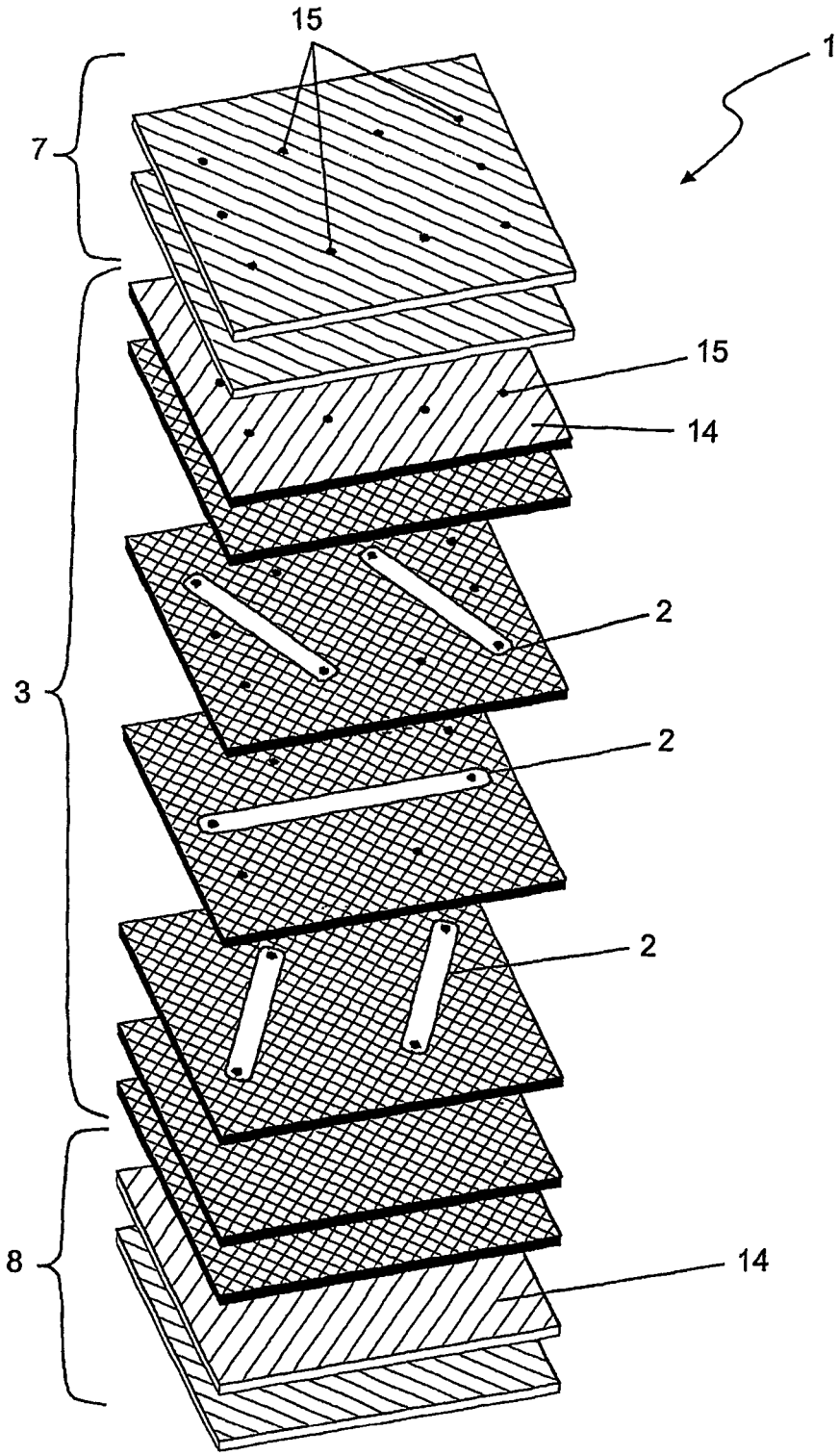
FIG. 1 is an exploded view of a 4 port circulator according to the invention.

FIG. 1 clearly shows the multilayer structure of the circulator according to the invention. The core 3 comprising hard magnetic material is composed of a total of seven layers. The strip conductor elements 2 are arranged on the three middle layers in such a way that the respective conductor planes come to lie over one another, resulting in the crossover pattern illustrated in FIG. 2. The conductor elements 2 cross over one another in pairs at an angle of 120°. According to FIG. 1, the upper outer layer 7 is composed of two layers of soft magnetic material. Likewise, the lower outer layer 8 comprises two soft magnetic layers, of which the upper one is metallized over its entire surface, so producing the electrically conductive separator layer 14 for separating the core 3 from the lower outer layer 8. Moreover, the top hard magnetic layer of the core 3 is metallized over its entire surface, thus forming a second electrically conductive separator layer 14 for separating the core 3 from the upper outer layer 7. Some of the layers of the circuit element illustrated in FIG. 1 are provided with plated-through openings 15 for contacting the conductor elements 2. FIG. 1 shows the structure of the foil stack into which the foils of unfired "green" ceramic substrate are stacked in the production method according to the invention after they have been cut to size and provided with plated-through openings 15 and after the strip conductor elements 2 have been printed on, for example by means of screen or stencil printing. Once the illustrated foils have been stacked, the foil stack is compacted and then sintered to yield the finished, non-reciprocal circuit element 1. After the sintering process, the core 3 is magnetized in accordance with the diagram illustrated in FIG. 3 by the application of appropriate external magnetic fields. Once these magnetic fields have been turned off, magnetization is established independently in the soft magnetic outer layers 7 and 8, said magnetization being indicated by the arrows 10 according to FIG. 3.

The invention claimed is:

1. A non-reciprocal circuit element having a plurality of strip conductor elements (2) insulated electrically from one another, which conductor elements are embedded in a multilayer core (3) of ferrimagnetic material and are arranged in superposed conductor planes in such a way that the conductor elements (2) cross over one another in at least one crossover area (4, 5), characterized in that the core (3) comprises, at least in the area (4, 5) where the conductor elements (2) cross over one another, hard magnetic material, which is permanently magnetized in a spatial direction perpendicular to the conductor planes.

2. A non-reciprocal circuit element as claimed in claim 1, characterized in that the conductor elements (2) cross over one another in pairs at an angle of 120°.

3. A non-reciprocal circuit element as claimed in claim 1, characterized by two spatially separate crossover areas (4, 5) of the conductor elements (2), the hard magnetic material of the core (3) being oppositely magnetized in the respective crossover areas (4, 5).

4. A non-reciprocal circuit element as claimed in claim 1, characterized by an upper and a lower outer layer (7, 8) of soft magnetic material.

5. A non-reciprocal circuit element as claimed in claim 4, characterized in that the upper and/or lower outer layers (7, 8) are separated from the core (3) each by an electrically conductive separator layer (14).

* * * * *